US006449138B2

(12) United States Patent
Aleardi

(10) Patent No.: US 6,449,138 B2
(45) **Date of Patent: *Sep. 10, 2002**

(54) ELECTRIC GAS-LIGHTER

(75) Inventor: Massimo Aleardi, Cassano Magnago (IT)

(73) Assignee: Miller Europe S.p.A., Via Privata Iseo (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/307,747

(22) Filed: May 10, 1999

(30) Foreign Application Priority Data

May 12, 1998 (IT) ..... TO98A0398

(51) Int. Cl.[7] ..... H05B 37/02
(52) U.S. Cl. ..... 361/253; 315/209 CD
(58) Field of Search ..... 361/247, 253, 361/256, 257, 263; 431/254, 255, 256, 257, 263, 264; 315/85, 206, 207, 208, 209 CD; 307/105, 157, 106

(56) References Cited

U.S. PATENT DOCUMENTS 3,644,075 A * 2/1972 Squiers ..... 431/254
3,681,001 A * 8/1972 Potts ..... 431/264
3,877,864 A * 4/1975 Carlson ..... 307/106
4,001,638 A * 1/1977 Bauer et al. ..... 315/209
4,450,499 A * 5/1984 Sorelle ..... 361/253
4,626,196 A * 12/1986 Stohere, Jr. ..... 431/264
5,621,278 A * 4/1997 Chambers ..... 315/209
5,862,033 A * 1/1999 Geislinger et al. ..... 361/257
6,242,866 B1 * 6/2001 Bianchi ..... 361/256

FOREIGN PATENT DOCUMENTS

EP EP 0 801 267 10/1997
IT 1175160 7/1987
JP 57-99272 * 6/1982

OTHER PUBLICATIONS

Integrated Publishing's Official Web Page, FILTERS, 1998.*
muRata, Technical Notes: Noise Suppression Principles Using EMI Filters, Dec. 2000.*
Sprague, Ceramic EMI/RFI Filters, 2000*
Syfer, Multilayer Ceramic EMI Filters, 1999.*

* cited by examiner

*Primary Examiner*—Brian Sircus
*Assistant Examiner*—Roberto J. Rios
(74) *Attorney, Agent, or Firm*—Lowe Hauptman Gilman & Berner, LLP

(57) ABSTRACT

An electric gas-lighter wherein a discharge generating circuit has input terminals connectable to a supply source, and at least one output terminal for generating sparks. The gas-lighter has a filter for eliminating electromagnetic noise and in turn having a single capacitor having a first terminal communicating with a reference potential, and a second terminal communicating with one of the input terminals via a resistor.

17 Claims, 2 Drawing Sheets

ELECTRIC GAS-LIGHTER

The present invention relates to an electric gas-lighter which may be applied, for example, to the cooking range of a gas cooker.

BACKGROUND OF THE INVENTION

Cooking ranges are known which are fitted with built-in electric gas-lighters operated manually to produce sparks and light gas flames on the range.

One type of cooking range with an electric gas-lighter (FIG. 1) comprises metal gas burners 2, each provided with a respective electrode 3 located to the side of the burner 2 and insulated electrically with respect to the grounded metal surface 4 supporting the burners.

When operated, the electric gas-lighter produces a spark between each electrode 3 and the respective burner 2 to light the flame of the burner supplied with gas.

FIG. 1 shows a complete circuit diagram of one known type of gas-lighter.

In addition to electrodes 3, the gas-lighter comprises a first and a second input terminal 7, 8 connectable to a supply line, e.g. an alternating mains line (not shown), by closing a switch (not shown); and an electric-discharge generating circuit 5 interposed between input terminals 7, 8 and electrodes 3, for producing the sparks on electrodes 3.

Circuit 5 comprises a resistor 9 having a first terminal connected to input terminal 7, and a second terminal connected to the anode of a rectifying diode 10, the cathode of which is connected to a first node 11.

Circuit 5 also comprises a capacitor 12 having a first terminal connected to node 11, and a second terminal connected to a node 13 in turn connected to second input terminal 8.

Circuit 5 also comprises a voltage discharge device 15 having a first terminal connected to node 11, and a second terminal connected to a first terminal 16*a* of a primary winding 16 of a transformer 17. The primary winding of transformer 17 has a second input terminal 16*b* connected to node 13, and transformer 17 also comprises two identical secondary windings 18, each having far more turns than primary winding 16.

The terminals of each secondary winding 18 are connected to respective electrodes 3.

The gas-lighter operates as follows.

When the switch (not shown) is closed to connect the gas-lighter circuit to the alternating supply line, the alternating mains voltage is rectified by diode 10 and a rectified voltage is applied to charge capacitor 12. When the voltage at the capacitor terminals reaches a threshold value $V_{TH}$ equal to the ignition threshold value of discharger 15, transformer 17 and capacitor 12 are connected, and capacitor 12 discharges via primary winding 16. A discharge current $I_{SC}$ of extremely high intensity (e.g. a 150–280 A peak) is thus generated and flows through primary winding 16, at the terminals of which a discharge voltage V1 (e.g. of 400 V) is generated during the discharge transient (lasting a few microseconds). Discharge voltage V1 induces, at the terminals of secondary windings 18, a voltage V2 much higher than V1 (e.g. 28 kV) and which is applied to electrodes 3. For each secondary winding 18, voltage V2 is sufficient to produce sparks between each electrode 3 and metal burner 2, which is grounded.

Gas-lighters of the above type have the drawback of generating, at the output (i.e. towards the supply mains) and during the discharge transient, severe electromagnetic noise above the limits laid down by European standards (EN55014 and following).

One proposed solution to the problem is to fit the gas-lighter with an electronic filter to reduce the electromagnetic noise at the output and so obtain a low-noise gas-lighter as shown in FIG. 2. In addition to the components described above (indicated using the same reference numbers), a low-noise gas-lighter comprises an electronic filter 20 interposed between terminals 7, 8 and a circuit 5*a* equivalent to circuit 5 but having no resistor 9.

Filter 20 comprises a first decoupling resistor 25*a* having a first terminal connected to terminal 7 and a second terminal connected to a node 22 communicating with the anode of diode 10 and with a first terminal of a capacitor 21*a* having a second terminal connected to a reference potential (ground). Filter 20 also comprises a second decoupling resistor 25*b* having a first terminal connected to terminal 8 and a second terminal connected to a node 23 communicating with node 13 and with a first terminal of a capacitor 21*b* having a second terminal connected to the reference potential (ground).

Capacitors 21*a* and 21*b* are thus located between respective nodes 22 and 23 and a common node 24 which is the ground.

Filter 20 defines a preferential path by which to discharge the electromagnetic energy produced during the discharge transient of capacitor 12. More specifically, this energy is conveyed by capacitors 21*a* and 21*b* directly towards ground 24 to reduce the electromagnetic emissions emitted by the circuit towards the supply mains.

Though filter 20 indeed provides for reducing the noise level generated during operation to well below the prescribed limit, gas-lighters fitted with filters 20 are not without further drawbacks.

Though minimum per gas-lighter, the expense of providing the filter with two capacitors is far from negligible on a mass-production scale, as in the household appliance industry.

SUMMARY OF THE INVENTION

It is an object of the present invention to provide an electric gas-lighter which is highly straightforward, and which at the same time provides for eliminating the drawbacks associated with gas-lighters of the type described above.

According to the present invention, there is disclosed an electric gas lighter having a discharge generating circuit comprising input terminals connectable to a supply source and at least one output terminal for generating sparks. The gas lighter also comprises a filter for filtering electromagnetic noise. The filter consists essentially of a single capacitor having a first terminal communicating with a reference potential and a second terminal communicating with one of the input terminals through a first resistor.

BRIEF DESCRIPTION OF THE DRAWINGS

A non-limiting embodiment of the present invention will be described by way of an example with reference to the accompanying drawings, in which.

DETAILED DESCRIPTION OF THE INVENTION

Figure 3:
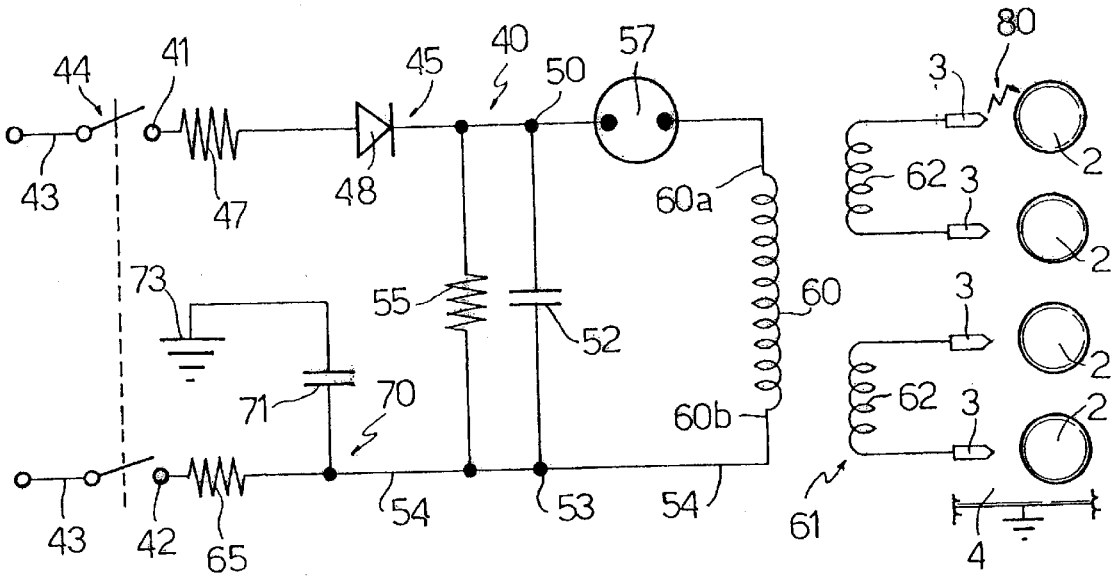
FIG. 3 shows a schematic electric diagram of an electric gas-lighter featuring a filter in accordance with the teachings of the present invention.

FIG. 3 shows a gas-lighter 40 comprising a first and a second input terminal 41, 42 connectable to an alternating supply line 43 by closing a switch 44; and an electric-discharge generating circuit 45 interposed between input terminals 41, 42 and electrodes 3, and for producing sparks on electrodes 3.

Circuit 45 comprises a resistor 47 having a first terminal connected to terminal 41, and a second terminal connected to the anode of a rectifying diode 48, the cathode of which is connected to a first node 50.

Circuit 45 also comprises a capacitor 52 having a first terminal connected to node 50, and a second terminal connected to a node 53.

Circuit 45 also comprises a resistor 55 parallel to capacitor 52; and a known discharger 57 (e.g. a Sidac high-energy, solid-state gas tube) having a first terminal connected to node 50, and a second terminal connected to a first terminal 60*a* of a primary winding 60 of a transformer 61. Primary winding 60 of transformer 61 has a second input terminal 60*b* connected to node 53, and transformer 61 also comprises two identical secondary windings 62, each having far more turns than primary winding 60.

The terminals of each secondary winding 62 are connected to respective electrodes 3, each facing and a short distance from a metal portion of a respective burner 2.

A filter 70 comprises a single capacitor 71 of capacitance C, which has a first terminal connected to a reference potential (ground) 73, and a second terminal communicating with node 53 via an electric line 54, which also communicates directly with terminal 60*b* of primary winding 60. The second terminal of capacitor 71 also communicates with input terminal 42 via a resistor 65 of resistance R.

Preferably but not exclusively, capacitance C of capacitor 71 is in nanofarads (e.g. ranges between 1 and 4.7 nanofarads); resistance R is in tens of kilohms (e.g. is about 15 kilohms); and filter 70 operates in the 150 kHz to 300 MHz frequency range and has a mean attenuation of about 20 dB.

In actual use, when switch 44 is closed, mains voltage is applied to terminals 41 and 42 so that a rectified voltage is applied to charge capacitor 52. When the voltage at the terminals of capacitor 52 reaches a threshold value equal to the ignition threshold value of discharger 57, transformer 60 and capacitor 52 are connected, and capacitor 52 discharges via primary winding 60. A discharge current of extremely high intensity is thus generated and flows through primary winding 60, at the terminals of which a discharge voltage (e.g. of 400 V) is generated during the discharge transient (lasting a few microseconds). The discharge voltage induces, at the terminals of secondary windings 62, a voltage much higher than the discharge voltage and which is applied to electrodes 3.

A spark 80 is thus generated between each electrode 3 and the outer body of the respective burner 2, and is accompanied by instantaneous current flow between the two burners 2 of each pair of electrodes 3, and through the metal surface supporting and grounding the burners.

The advantages of filter 70 are as follows.

Using a single capacitor as opposed to two not only simplifies the gas-lighter but also provides for reducing production time and cost, which, in mass production terms, affords considerable savings even when eliminating only one component.

Figure 1:
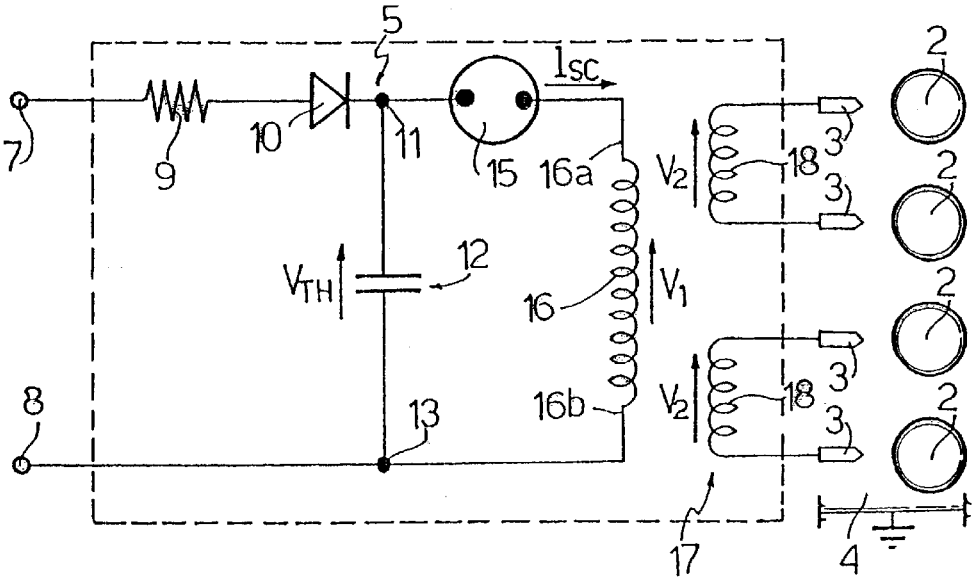
Fig. 1 (Prior Art)
FIG. 1 shows a schematic electric diagram of a known filterless electric gas-lighter.
Figure 2:
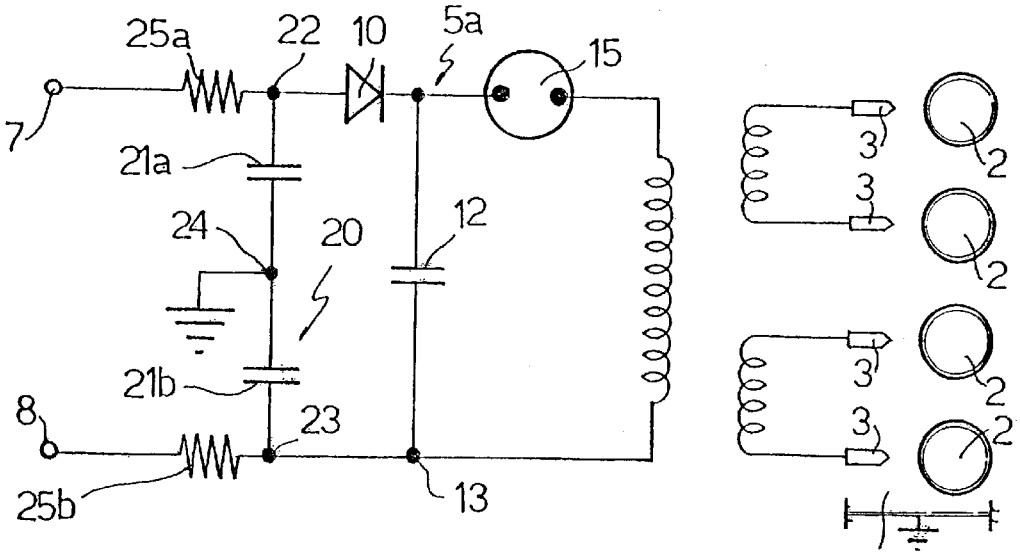
Fig. 2 (Prior Art)
FIG. 2 shows a schematic electric diagram of a known electric gas-lighter fitted with a filter.

The two-capacitor filter of the electric gas-lighter described with reference to FIG. 2 was based on the preconceived idea that a two-capacitor filter was the only possible way of effectively reducing electromagnetic noise, which was believed to be impossible using a single-capacitor filter. In actual fact, tests of the gas-lighter according to the invention have shown the effectiveness of filter 70 to be equal to, if not greater than, that of the two-capacitor filter in FIG. 2, and that most of the electromagnetic noise flows along line 54 fitted with filter 70. As such, being fitted along line 54 extending directly between terminal 60*b* of primary winding 60 and input terminal 42, filter 70 provides for blocking most of the electromagnetic noise.

Clearly, changes may be made to the electric gas lighter described and illustrated herein without, however, departing from the scope of the present invention.

What is claimed is:

1. An electric gas-lighter, comprising a discharge generating circuit (45) having input terminals (41, 42) connectable to a supply source (43) and at least one output terminal (3) for generating sparks; and a filter (70) for filtering electromagnetic noise;

wherein said filter (70) consists essentially of a single capacitor (71) having a first terminal communicating with a reference potential (73), and a second terminal communicating with one (42) of said input terminals (41, 42) via a first resistor (65); and wherein said discharge generating circuit comprises a transformer having a primary winding and at least one secondary winding communicating with said output terminal;

a main capacitor having third and fourth terminals connected to said input terminals, respectively, via a rectifying circuit; and a discharging circuit connected to said main capacitor to discharge the current accumulated in said main capacitor into the primary winding of said transformer.

2. The gas-lighter as claimed in claim 1, wherein said filter (70) is located along a line extending directly between a terminal (60*b*) of said primary winding (60) and one (42) of said input terminals (41, 42).

3. The gas-lighter as claimed in claim 1, further comprising a second resistor (47) interposed between one (41) of said input terminals (41, 42) and said rectifying circuit (48).

4. The gas-lighter as claimed in claim 1, wherein said single capacitor (71) has a capacitance (C) in nanofarads, and said first resistor have a resistance (R) in tens kilohms.

5. The gas-lighter as claimed in claim 1, wherein said filter (70) operates in the 150 kHz to 300 MHz frequency range.

6. The gas-lighter as claimed in claim 1, wherein said filter (70) has a mean attenuation of about 20dB.

7. The gas-lighter as claimed in claim 1, wherein the second terminal of the single capacitor is directly electrically connected to the fourth terminal of the main capacitor.

8. The gas-lighter as claimed in claim 7, wherein said single capacitor has a capacitance in nanofarads, and said first resistor have a resistance in tens kilohms.

9. An electric gas-lighter, comprising:

a discharge generating circuit having input terminals connectable to a supply source and at least one output terminal for generating sparks; and a filter for filtering electromagnetic noise;

wherein said filter consists essentially of a single capacitor having a first terminal communicating with a reference potential, and a second terminal communicating with one of said input terminals via a first resistor; and wherein said discharge generating circuit comprises a transformer having a primary winding and at least one secondary winding communicating with said output terminal;

a main capacitor having third and fourth terminals connected to said input terminals, respectively, via a rectifying circuit; and a discharging circuit connected to said main capacitor to discharge the current accumulated in said main capacitor into the primary winding of said transformer;

said gas-lighter further comprising a third resistor parallel to said main capacitor.

10. The gas-lighter as claimed in claim 9, wherein the second terminal of the single capacitor is directly electrically connected to the fourth terminal of the main capacitor.

11. The gas-lighter as claimed in claim 10, wherein said single capacitor has a capacitance in nanofarads, and said first resistor have a resistance in tens kilohms.

12. An electric gas-lighter, comprising a discharge generating circuit having input terminals connectable to a supply source and at least one output terminal for generating sparks, said discharge generating circuit including a transformer having a primary winding and at least one secondary winding communicating with said output terminal;

a main capacitor having terminals connected to said input terminals; and a discharging circuit connected between said main capacitor and the primary winding of said transformer so that said main capacitor and the primary winding are connected in parallel when said discharging circuit becomes conductive, thereby discharging the energy accumulated in said main capacitor into the primary winding of said transformer; and a filter for filtering electromagnetic noise, said filter consists essentially of a single filter capacitor having a first terminal communicating with a reference potential, and a second terminal communicating with one of said input terminals.

13. The gas-lighter as claimed in claim 12, further comprising a rectifying circuit connected between the other of said input terminals and the respective terminal of said main capacitor.

14. The gas-lighter as claimed in claim 13, wherein said rectifying circuit includes a diode having a cathode connected to the other of said input terminals and an anode connected to the respective terminal of said main capacitor.

15. The gas-lighter as claimed in claim 12, wherein said filter capacitor has a capacitance in nanofarads.

16. The gas-lighter as claimed in claim 12, wherein the primary winding of the transformer is electrically isolated from the at least one secondary winding thereof.

17. An electric gas-lighter, comprising:

a discharge generating circuit having input terminals connectable to a supply source and at least one output terminal for generating sparks, said discharge generating circuit including:

a transformer having a primary winding and at least one secondary winding communicating with said output terminal;

a main capacitor having terminals connected to said input terminals; and a discharging circuit connected between said main capacitor and the primary winding of said transformer so that said main capacitor and the primary winding are connected in parallel when said discharging circuit becomes conductive, thereby discharging the energy accumulated in said main capacitor into the primary winding of said transformer; and a filter for filtering electromagnetic noise, said filter consists essentially of a single filter capacitor having a first terminal communicating with a reference potential, and a second terminal communicating with one of said input terminals;

said gas-lighter further comprising a resistor connected in parallel with said main capacitor at all times.

* * * * *